US005749715A

United States Patent [19]

Laing

[11] Patent Number: 5,749,715

[45] Date of Patent: May 12, 1998

[54] CIRCULATION-HEATING ELEMENT DEVICE

[76] Inventor: Karsten Andreas Laing, 1253 La Jolla Rancho Rd., La Jolla, Calif. 92037

[21] Appl. No.: 800,452

[22] Filed: Feb. 18, 1997

[30] Foreign Application Priority Data

Feb. 21, 1996 [DE] Germany ..... 196 06 369.8

[51] Int. Cl.[6] ..... H05B 1/02; F24H 1/12

[52] U.S. Cl. ..... 417/313; 392/488; 417/363

[58] Field of Search ..... 392/488, 489, 392/486; 417/313, 363

[56] References Cited

U.S. PATENT DOCUMENTS 2,266,216 12/1941 Kimberlin ..... 392/489

2,879,372 3/1959 Dammond ..... 392/489

5,094,593 3/1992 Laing ..... 417/313

5,113,931 5/1992 Oswalt et al. ..... 392/488 X

*Primary Examiner*—Richard Gluck

[57] ABSTRACT

A circulation and heating device for a hot tub, consisting of a motor-pump-unit and a pipe forming a stand, whereby said pipe ends in a dry portion of the pump housing, and contains a rod shaped resistance heating element with the leads on one end which receive their power supply from inside said dry portion, and that the water conveyed through the pipe leaves through a lateral opening of the pipe which communicates with the suction side of the pump.

1 Claim, 1 Drawing Sheet

CIRCULATION-HEATING ELEMENT DEVICE

BACKGROUND OF THE INVENTION

The invention relates to a circulation unit consisting of a circulation pump and a resistance heater element to heat up the water of a hot tub.

PRIOR ART

U.S. Pat. No. 5,094,593 describes a circulation device for a container in which the water enters the circulation unit at one end and exits at the other end, consisting of a pump, a heating device, a temperature sensor with switch for the motor of the pump, and a long connection pipe which contains the rod-shaped resistance heating element which forms the heating device. The whole unit will be installed below the container, which requires sufficient space under the container.

In many cases, especially in continuously heated hot tubs covered by an insulating lid, the inlet and outlet openings between the hot tub and the circulation device are close to each other, because there is only a very limited space between the tub and its outer shell. In addition the hot tub which may weigh more than a ton is normally placed on an insulated base plate, therefore the circulating and heating units according to the prior art are not suited for hot tubs.

SUMMARY OF THE INVENTION

The invention overcomes these disadvantages by a pump-heater-unit which fulfills the same tasks as the unit according to the prior art; however, it is confined to a small space and is standing on the floor. This is achieved by placing the heating element inside the suction pipe. The suction pipe is bent into a configuration which supports the pump-motor-unit. This pipe is connected via a dry area of the pump housing with the motor-pump-unit whose axis of rotation runs horizontally. The inside of the suction pipe communicates via a lateral opening with the inlet port of the pump housing. The support-forming pipe is pressed against the inlet port by a lid-element, so that the motor-pump-unit forms a compact module with the support which at the same time acts as heater and suction pipe.

DESCRIPTION OF THE PREFERRED EMBODIMENTS OF THE INVENTION

Figure 1:
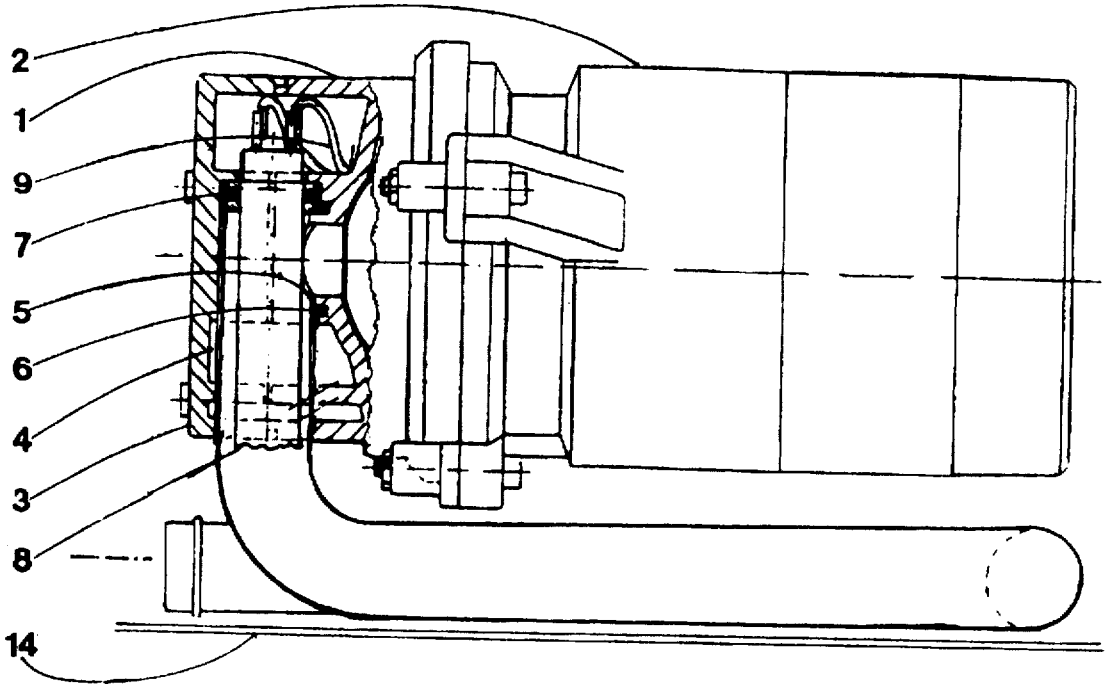
FIG. 1 shows a motor-pump-heater unit in a plane parallel to the axis of rotation.

In FIG. 1 the outer part of the pump housing 1 forming a unit with the electric motor 2 is designed as a lid 3 which presses pipe 4, which has a lateral opening for the transfer of the water flow into the pump against the semi-cylindrically shaped inlet port 5 of the pump housing. This semi-cylindrical area 5 has the same radius as the outer radius of pipe 4. The lateral opening in pipe 4 has the same size as the inlet port of the pump housing. A first 0-ring 6 seals between the semi cylindrical area 5 and pipe 4. A second ring 7 seals the annular clearance between the inner wall of pipe 4 and the rod-shaped heating element 8. Both electrical leads 9 leave the heating element 8 on the same end. Pipe 4, containing this heating element 8, is bent to form a support whose base consists of the two parallel portions 13. Pipe 4 is pressed against the first 0-ring 6 by lid 3 which is screwed to the pump housing 1. Thus, the motor-pump-unit forms a unit with pipe 4 which contains the heating element 8 and which also forms the support for the motor-pump-unit.

Figure 2:
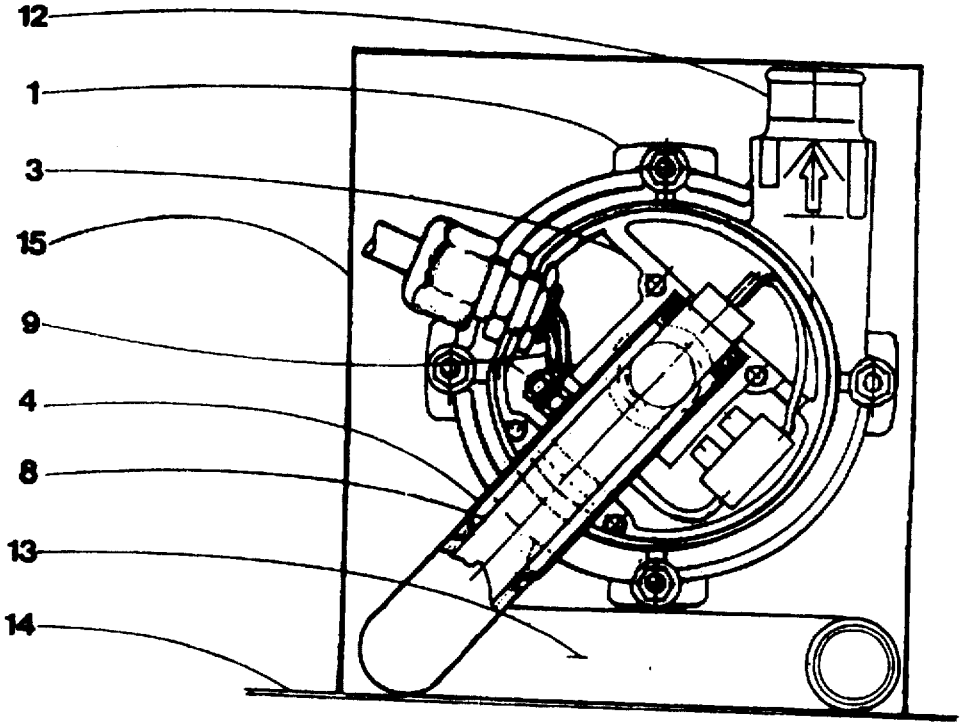
FIG. 2 shows a motor-pump-heater unit in a plane perpendicular to the axis of rotation.

FIG. 2 shows the same layout in the plane of rotation. The end section of pipe 4 which encloses the end of the heating element 8 forms an angle of about 450° with the vertical. This guarantees that air bubbles can pass through the impeller. The lower part of pipe 4 is bent in such a way that the two portions 13, running parallel to the axis of the pump, rest on base 14. The required space is reduced to parallelepiped 15 which has about the same length as the motor-pump-unit.

I claim:

1. A circulation unit comprising a motor-pump-unit having a circulation pump with a pump housing and a resistance heating element which is situated in a suction pipe of the pump in order to heat fluid content of a hot tub, characterized in that a) the suction pipe (4) having a rod-shaped heating element (8) therein, the suction pipe (4) being bent to form a support which carries the motor-pump-unit, b) an end of the suction pipe (4) facing the pump has a lateral opening through which the inside of the pipe communicates with an inlet port of the pump housing (1), c) the inlet port of the pump housing (1) lies in a semi-cylindrical groove (5), d) a lid (3) which is connected by screws to the pump housing (1) presses the end portion of the pipe (4) against an 0-ring (6) which forms a seal between the pipe (4) and the inlet port of the pump, e) a second ring (7) seals an annular space between the inside of the pipe (4) and an end portion of the heating element (8), f) leads of the heating element (8) end in a dry chamber formed by the lid (3) and the pump housing (1), g) an outlet end of the pipe (4) runs upwards and forms an angle of 45° with the vertical, h) a lower part of the pipe (4) is bent in a U-shape, whereby two portions (13) run parallel to each other and rest on a base (14).

* * * * *